US011459855B2

(12) United States Patent
Saraya et al.

(10) Patent No.: US 11,459,855 B2
(45) Date of Patent: Oct. 4, 2022

(54) METHODS AND SYSTEMS FOR CEMENTING THROUGH SCREENS

(71) Applicant: Vertice Oil Tools, Inc., Missouri City, TX (US)

(72) Inventors: Mohamed Ibrahim Saraya, Sugar Land, TX (US); Andrew John Webber, Missouri City, TX (US)

(73) Assignee: Vertice Oil Tools Inc., Stafford, TX (US)

( * ) Notice: Subject to any disclaimer, the term of this patent is extended or adjusted under 35 U.S.C. 154(b) by 151 days.

(21) Appl. No.: 17/013,707

(22) Filed: Sep. 7, 2020

(65) Prior Publication Data

US 2020/0399985 A1 Dec. 24, 2020

Related U.S. Application Data

(63) Continuation of application No. PCT/US2019/032108, filed on May 14, 2019.

(60) Provisional application No. 62/678,307, filed on May 31, 2018.

(51) Int. Cl.

| | |
|---|---|
| ***E21B 33/14*** | (2006.01) |
| ***E21B 43/08*** | (2006.01) |
| ***E21B 34/14*** | (2006.01) |
| ***E21B 34/06*** | (2006.01) |
| ***E21B 43/26*** | (2006.01) |

(52) U.S. Cl.

CPC ..... *E21B 34/142* (2020.05); *E21B 33/14* (2013.01); *E21B 34/063* (2013.01); *E21B 43/08* (2013.01); *E21B 43/26* (2013.01); *E21B 2200/06* (2020.05)

(58) Field of Classification Search

CPC ..... E21B 33/14; E21B 34/063; E21B 43/08; E21B 2200/06; E21B 33/00

See application file for complete search history.

(56) References Cited

U.S. PATENT DOCUMENTS

| | | | | |
|---|---|---|---|---|
| 5,330,003 | A * | 7/1994 | Bullick | E21B 43/10 166/278 |
| 6,719,051 | B2 * | 4/2004 | Hailey, Jr. | E21B 43/08 166/278 |
| 6,761,218 | B2 * | 7/2004 | Nguyen | E21B 43/086 166/308.1 |
| 7,527,103 | B2 * | 5/2009 | Huang | C09K 8/68 166/205 |
| 9,181,781 | B2 * | 11/2015 | Agrawal | E21B 43/08 |
| 2005/0121192 | A1 * | 6/2005 | Hailey, Jr. | E21B 43/045 166/278 |

* cited by examiner

*Primary Examiner* — Catherine Loikith

(74) *Attorney, Agent, or Firm* — Pierson IP, PLLC

(57) ABSTRACT

A tool comprising a movable sleeve with an inner diameter, an outer diameter, and a screen. The screen being configured to filter materials flowing into a first port within the moveable sleeve, wherein the outer diameter of the movable sleeve is positioned adjacent to an inner diameter of the tool, wherein the screen is configured to move with the moveable sleeve. The tool further comprising a temporary member positioned on the inner diameter of the moveable sleeve, the temporary member being configured to temporarily cover an inner sidewall of the screen.

20 Claims, 3 Drawing Sheets

METHODS AND SYSTEMS FOR CEMENTING THROUGH SCREENS

BACKGROUND INFORMATION

Field of the Disclosure

Examples of the present disclosure relate to a downhole tool, wherein the screen is provisionally protected by a temporary member that is removable, and contained between two seals.

Background

Hydraulic fracturing is the process of creating cracks or fractures in underground geological formations. After creating the cracks or fractures, a mixture of water, sand, and other chemical additives, are pumped into the cracks or fractures to protect the integrity of the geological formation and enhance production of the natural resources. The cracks or fractures are maintained opened by the mixture, allowing the natural resources within the geological formation to flow into a wellbore, where it is collected at the surface.

Additionally, during the fracturing process, materials may be pumped through downhole tools to enhance the well productivity. One of the tools pumped through the downhole tools are balls, or similar devices, herein will be referred collectively as frac balls or balls. The balls are configured to block off or close portions of a well to allow pressure to build up, causing the cracks or fractures propagation in the geological formations.

Current or existing completion strings with downhole tools that use balls in wellbores are comprised of a plurality of tapered sidewalls. In order to activate each downhole tool, properly sized balls are pumped along with the mixture inside of the wellbore. Subsequent pumped balls may have a larger diameter. The larger is smaller than the opening of all of the upper downhole tools, but larger than the one it is intended to open. Thus, current or existing completion strings utilize downhole tools in wellbores require balls of proper size to be sequentially pumped into a completion string.

When a properly sized ball is positioned within a corresponding downhole tool, the positioning of the ball exerts pressure causing the downhole tool activation or opening, consequently causing the pressure to fracture or crack in the geological formation. At the completion of each fracturing stage, a larger sized ball is injected into the completion string, which opens up the next downhole tool. This process repeats until all of the downhole tools are opened, and multiple fractures are created in the wellbore.

Post fracture operation, each sleeve or downhole tool is left opened making the well prone to sand production from the proppant and sand pumped during the fracturing operation and used to open cracks and fissure into geological formation Further, there is a need to develop a tool that retain and prevent sand pumped into the formation from flowing back into the wellbore and the surface since this may cause the fracture or cracks to close again.

Accordingly, needs exist for system and methods utilizing a sliding downhole tool with a screen that is shielded from cement by a temporary member, wherein the temporary member may be removed to allow the wellbore to be utilized after being cemented.

SUMMARY

Embodiments disclosed herein describe a downhole tool with or without an expandable ball seat, for simplicity the embodiments include an expandable seat. More specifically, embodiments include ball seat within a downhole tool such as a frac sleeve, configured to allow a single ball to treat a plurality of zones associated with a plurality of downhole tools.

In embodiments, a downhole tool with the inner sleeve and outer sidewall may be run with the casing to a desired depth. Cement is pumped within the wellbore to fix the casing and the tool in place at the desired depth. The cement is then displaced by completion fluid inside the casing while allowed to cure externally to provide the support and isolation.

The outer sidewall may include an outer frac port, recess, and an adjustable member.

The inner sleeve may include an inner frac port, an expandable ball seat, a screen, and a temporary member, wherein the temporary member is removable by dissolving or any other method.

In implementations, a ball may be dropped within the inner sleeve and positioned on the expandable ball seat, seat, dynamic seal that is configured to be opened and closed, etc. (referred to hereinafter collectively and individually as "expandable ball seat"). When the ball is positioned on the expandable ball seat, pressure may be applied within the downhole tool to compress the adjustable member. Responsive to compressing the adjustable member, the inner sleeve may slide vertically within the outer sidewall.

In embodiments, responsive to vertically moving the inner sleeve, the outer frac port may become aligned with the inner frac port. When the outer frac port and inner frac port are aligned, fracking fluid may be transmitted from a position within the inner sleeve to a position outside of the outer sidewall via the aligned frac ports. downhole tool In embodiments, as the pressure within the downhole tool is decreased, based on no longer pumping the fracking fluid through the inner diameter of the downhole tool, the adjustable member may expand or contract. Responsive to the expanding or contracting of the adjustable member, the inner downhole tool may slide causing the expandable ball seat to be aligned with the recess. When the expandable ball seat is aligned with the recess, the expandable ball seat may expand horizontally into the recess. Once the expandable ball seat expands, a diameter of the expandable ball seat may have a diameter that is greater than the ball. This may allow the ball to slide through the adjustable member and into a lower positioned, second downhole tool.

Additionally, when the adjustable member is expanded, the screen, which may be a screen, check valve, slotted grooves or flapper (referred to hereinafter collectively and individually as "a screen") on the inner sleeve, may be aligned with the outer frac port. In embodiments, the screen, check valve, slotted grooves or flapper may be configured to filter materials flowing from the geological formation into the downhole tool including sand that has been pumped, allowing only hydrocarbon and other fluids to flow into or out of the downhole tool.

The temporary member may be positioned closer to a proximal surface of the sleeve than the screen, create an overhang away from the inner sleeve, and extend downward to create a shield over portions of an inner sidewall of the screen. The positioning of the temporary member to not extend completely through the inner sidewall of the screen allows the communication of pressure between the inner diameter of the tool and a cavity housing the screen, such that the temporary member does not create an atmospheric chamber or low-pressure chamber relative to the inside diameter within the cavity housing the screen. When filling the hole with cement, the cement may flow around and attach to the temporary member without entering into the protected screen, which may also be contained in between two or more seals that may prevent flowing through the screen. Furthermore, the temporary member may be removable after a predetermined amount of time, dissolve due to temperature, or a combination. As such, once the temporary member has dissolved, the inner sidewall of the screen may be exposed to the inner diameter of the tool.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions or rearrangements.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

Figure 1:
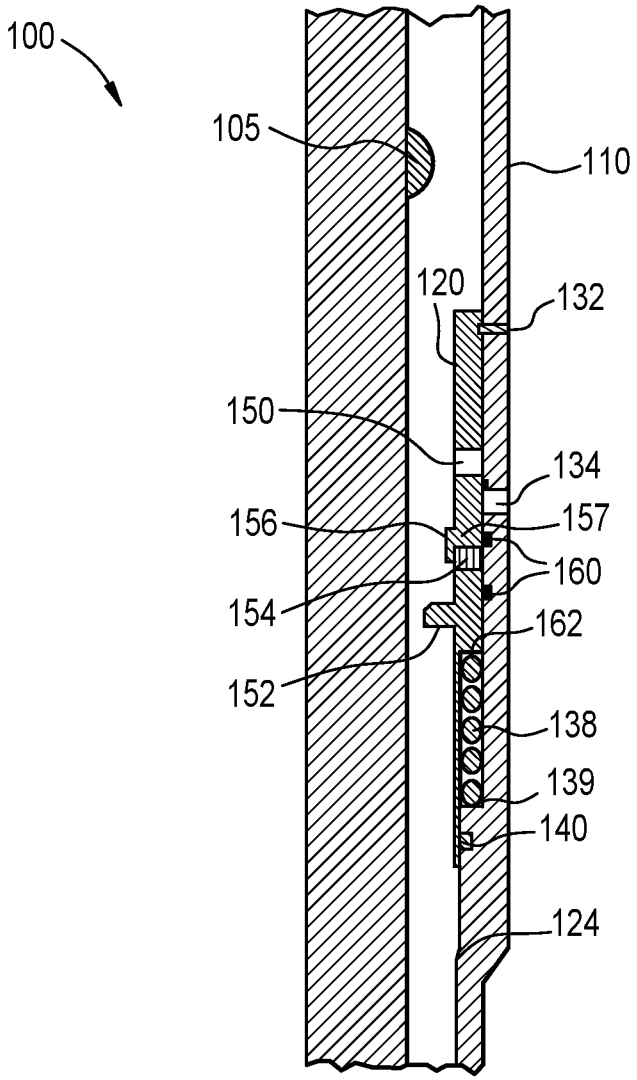
FIG. 1-4 depict operations associated with a downhole tool, according to an embodiment.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

In the following description, numerous specific details are set forth in order to provide a thorough understanding of the present invention. It will be apparent, however, to one having ordinary skill in the art that the specific detail need not be employed to practice the present invention. In other instances, well-known materials or methods have not been described in detail in order to avoid obscuring the present invention.

Turning now to FIG. 1, FIG. 1 depicts a downhole tool 100, according to an embodiment. In embodiments, a wellbore may include a plurality of downhole tools 100, which may be vertically aligned across their axis with one another. The plurality of downhole tools 100 may be aligned such that a first downhole tool 100 is positioned above a second downhole tool 100. Each downhole tool 100 may be utilized to control the flow of fluid, gases, mixtures, etc. within a stage of a wellbore.

Downhole tool 100 may include outer sidewall 110 and inner sleeve 120, wherein a frac ball 105 may be configured to be positioned within a hollow chamber. The frac ball 105 may be configured to control a pressure within the hollow chamber to allow for relative movement of elements of downhole tool 100.

Outer sidewall 110 and inner sleeve 120 may include the hollow chamber, channel, conduit, passageway, etc. The hollow chamber may extend from a top surface of outer sidewall 110 and inner sleeve 120 to a lower surface of outer sidewall 110 and inner sleeve 120.

Inner sleeve 120 may be positioned within the hollow chamber, and be positioned adjacent to outer sidewall 110. In embodiments, an outer diameter of inner sleeve 120 may be positioned adjacent to an inner diameter of outer sidewall 110. Outer sidewall 110 and inner sleeve 120 may have parallel longitudinal axis, and may include tapered sidewalls.

Outer sidewall 110 may include a shearing device, called shear screws 132 therefater, outer frac port 134, adjustable member 138, and seal 140, and seal pair 160.

shear screws 132 may be positioned within outer sidewall 110, and extend into portions of inner sleeve 120. shear screws 132 may be configured to temporarily couple inner sleeve 120 with outer sidewall 110. When coupled together, inner sleeve 120 may be secured to outer sidewall 110 at a fixed position within the hollow chamber of outer sidewall 110. Inner sleeve 120 and outer sidewall 110 may remain coupled until a predetermined amount of force is applied within the hollow chamber, wherein the force within inner sleeve 120 may be generated by pumping fluid through the hollow chamber or by landing ball 105 on ball seat 152. Responsive to the predetermined amount of force being applied within the hollow chamber, shear screws 132 may break, be removed, etc., and allow inner sleeve 120 to slide downward and/or upward relative to outer sidewall 110.

Outer frac port 134 may be an opening, orifice, etc. extending through outer sidewall 110. Outer frac port 134 may be configured to control the flow of fluid, fracking materials, natural resources and any fluid through the hollow chamber. In embodiments, outer frac port 134 may be configured to be misaligned and aligned with ports and screens, check valves or flappers associated with inner sleeve 120. When misaligned with the ports and/or screens, check valves or flappers within inner sleeve 120, outer frac port 134 may be sealed. When aligned with the ports and/or screens, check valves or flappers within inner sleeve 120, outer frac port 134 may allow downhole tool 100 to be operational for either frac or production. In embodiments, outer frac port 134 may be the only opening extending through the outer sidewall.

In a first mode of operation, outer frac port 134 may be covered by inner sleeve 120 forming a seal between the annulus and the inner diameter of the tool. In a second mode of operation, outer frac port 134 utilized to transport fracking mixtures from a location within the hollow chamber into geological formations positioned adjacent to the outer diameter of outer sidewall 110. In a third mode of operation, outer frac port 134 may be configured to receive natural resources from the geological formations, and the wellbore may be open for production.

Adjustable member 138 may be a device or fluid chamber that is configured to move inner sleeve 120. For example, adjustable member 138 may be a spring, hydraulic lift, etc. In embodiments, a lower surface of adjustable member 138 may positioned on ledge 139, and an upper surface of adjustable member 138 may be positioned adjacent to projection 162 on inner sleeve 120. Responsive to being compressed, adjustable member 138 may shorten the distance between ledge 139 and projection 162. Furthermore, responsive to being compressed, adjustable member 138 may allow inner sleeve 120 to slide within outer sidewall 110. In embodiments, adjustable member 138 may be positioned below recess 136. However, in other embodiments adjustable member 138 may be positioned in various places in relation to inner sleeve 120.

Shear screws 132 may be positioned within outer sidewall 110, and extend into portions of inner sleeve 120. Shear screws 132 may be configured to receive force from adjustable member 138. Shear screws 132 may be configured to secure the inner sleeve 120 in place until a predetermined amount of force is applied within the hollow chamber, a ball 105 is dropped on ball seat 152, or until a predetermined amount of time has lapsed. Responsive to the predetermined amount of force being created or the predetermined amount of time lapsing, shear screws 132 may be removed from downhole tool 100, and allow adjustable member 138 and inner sleeve 120 to slide within the hollow chamber to a second ledge 124.

Seal 140 may be a seal that is configured to null, limit, reduce, etc. fluids, materials, etc. from flowing into a chamber housing adjustable member 138 from the inner diameter of tool 100.

Second ledge 124 may be positioned proximate to a distal end of downhole tool 100. Second ledge 124 may be a projection, protrusion, etc. that extends from outer sidewall 110 into the hollow chamber. In embodiments, responsive to shear screws 132 being removed, a bottom surface of inner sleeve 120 may slide within the hollow chamber to be positioned adjacent to and on top of second ledge 124. When the distal end of inner sleeve 120 is positioned adjacent to second ledge 124, outer frac port 134 may be aligned inner frac port 150. Furthermore, when the distal most end of inner sleeve 120 is positioned adjacent to second ledge 124, inner sleeve 120 may not be able to slid further towards the distal end of downhole tool 100.

Seal pair 160 may be configured to form a pair of seals that straddles a cavity housing screen 154. Seal pair 160 may be configured to null, limit, or reduce the amount of fluids, materials, cement, etc. Specifically, seal pair 160 may extend across an annulus between inner sleeve 120 and outer sidewall 110 to limit the movement of fluids and materials. As such, the inner sidewall of the cavity housing screen 154 may be shielded from materials flowing into screen 154 via temporary member 156, and an outer sidewall of the cavity housing screen may be shielded from materials flowing into screen 154 via seals 160. In embodiments, seal pair 160 may be in a fixed position on outer sidewall 110, such that if inner sleeve 120 moves such that screen 154 is no longer aligned between seal pair 160, materials may flow into the cavity housing screen 154.

Inner sleeve 120 may include an inner frac port 150, ball seat 152, screen 154, temporary member 156.

Inner frac port 150 may be an opening, orifice, etc. extending through inner sleeve 120. Inner frac port 150 may be configured to control the flow of fluid, fracking materials, and natural resources through the hollow chamber. In embodiments, inner frac port 150 may be configured to be misaligned and aligned with outer frac port 134. When inner frac port 150 is misaligned with the outer frac port 134 and in a first mode, the sidewalls of inner sleeve 120 may form a seal, and may not allow fluid to flow from the hollow into the geological formations via outer frac port 134. In embodiments, when operational, adjustable member 138 may be compressed, this may align inner frac port 150 with outer frac port 134. When aligned inner frac port 150 and outer frac port 134 may form a continuous passageway allowing fracking fluid, other fluid or material to flow from the inner chamber into the geological formations to fracture and/or crack the geological formations.

Ball seat 152 may be configured to secure a ball within the hollow chamber. Ball seat 152 may have fixed width inner diameter or may have a dynamically sized inner diameter comprised of two or more semi-circles with a hollow center. In other words, ball seat 152 may be substantially donut shaped. The variable diameter of ball seat 152 may change based on a diameter of a structure positioned adjacent to the outer diameter circumference of ball seat 152. Thus, ball seat 152 may expand to have a circumference substantially the same size as the structure positioned adjacent to the outer diameter of Ball seat 152 and inside circumference slightly bigger than inner sleeve 120.

Screen, check valve, slotted grooves or flapper 154 may be a filter, semi-permeable passageway, etc. positioned within an opening extending through inner sleeve 120, wherein the opening may be positioned above or below inner frac port 154. In embodiments, during a fracturing procedure, screen may be misaligned with outer frac port 134. During a production process, screen 154 may be aligned with outer frac port 134. Screen 154 may allow for the production of natural resources within the geological formations to be transported into the hollow chamber, or allow fluid can be injected back to geological formation. However, screen 154 may limit the materials that may traverse into or through screen 154. This may limit sand or other undesirable materials from entering the hollow chamber from the geological formation.

Temporary member 156 may be a dissolvable, removable, temporary, etc. device that is configured to be positioned or attached by threading within a recess 157 within inner sleeve 120. Recess or thread 157 may allow portions of temporary member 156 to be embedded within inner sleeve 120 to secure temporary member 156 to inner sleeve 120. Temporary member 156 may be configured to disappear or dissolve after a predetermined amount of time, due to heat, mechanical removal, or a combination. Temporary member 156 creates an overhang over screen 154, and extends vertically to partially cover screen 154. As such, temporary member 156 may not extend along the entirety of the inner sidewall of screen 154. This may allow temporary member 156 to shield a cavity housing screen 154 when cement is being positioned within the well. Furthermore, by only partially covering an inner sidewall of screen 154, temporary member 156 may allow pressure communication between the inner diameter of tool 100 with the cavity housing screen 154 without forming an atmospheric chamber within the cavity.

Figure 2:
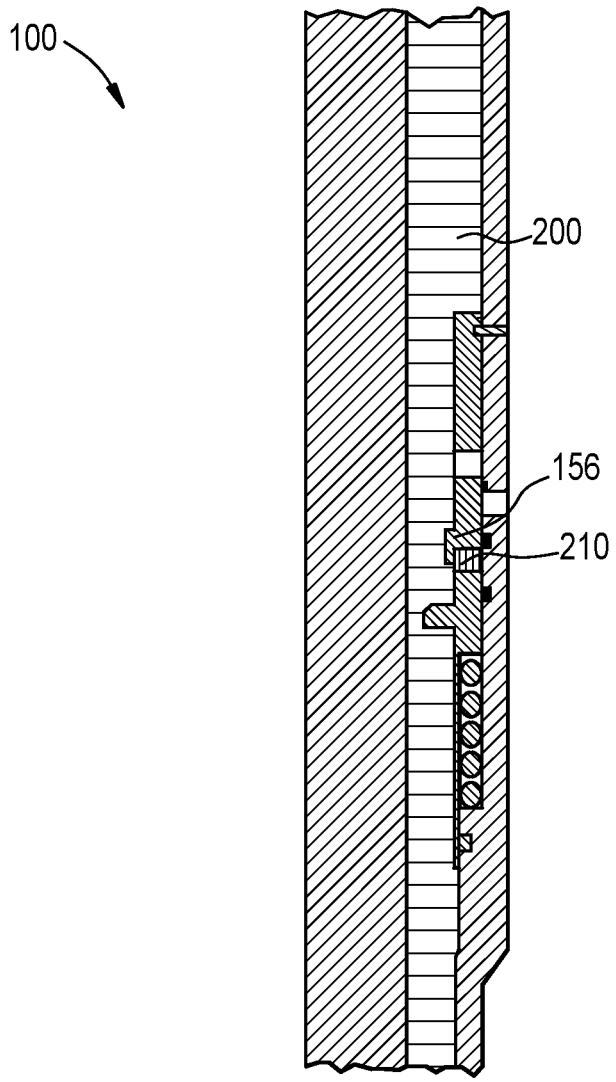

FIG. 2 depicts an embodiment of a downhole tool 100 that has been filled with cement 200. As depicted in FIG. 2 as cement 200 fills the hollow inner diameter of downhole tool 100, temporary member 156 may shield the cavity 210 housing screen 154, which may null, limit, reduce, decrease an amount of cement 200 that is able to be positioned or enter within cavity 210. Specifically, cement 200 may affix to the overhang and sidewall of temporary member 156 without entering cavity 210, which may allow the screen to be utilized once the cement is removed from the hollow inner diameter of downhole tool 100.

Figure 3:
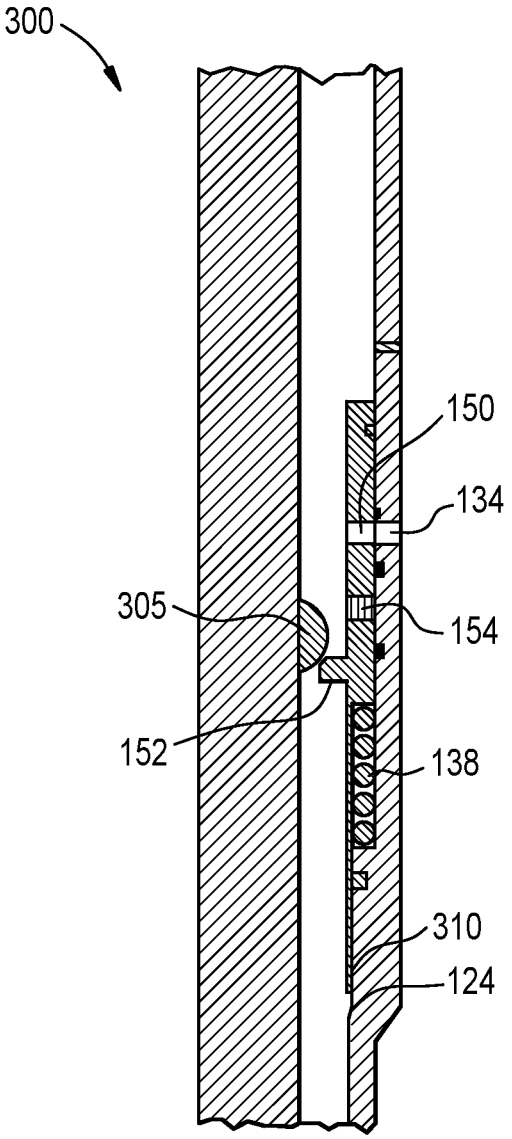
Figure 4:
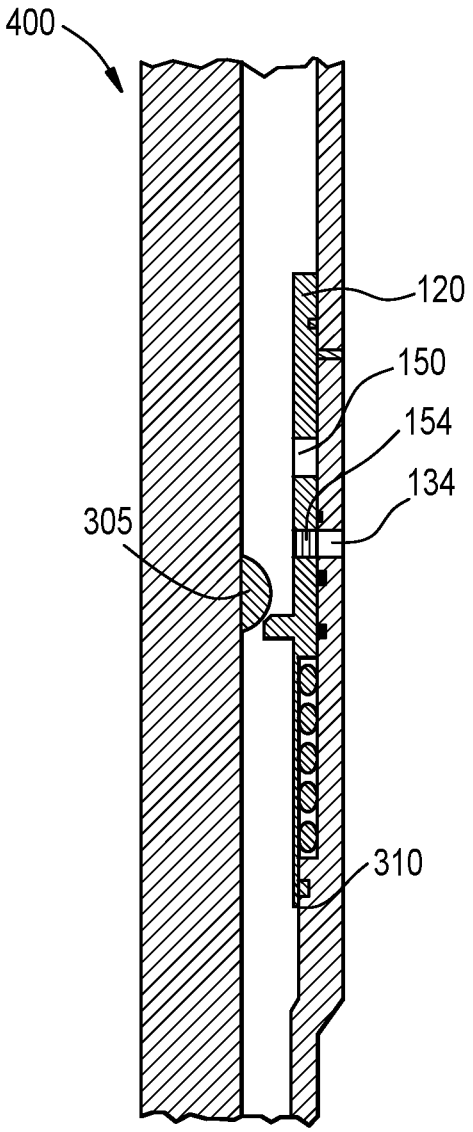

FIGS. 3-4 depicts additional phases of a method 200 for operating a downhole tool 100. The operations of the method depicted in FIGS. 3-4 are intended to be illustrative. In some embodiments, the method may be accomplished with one or more additional operations not described, and/or without one or more of the operations discussed. Additionally, the order in which the operations of the method are illustrated in FIGS. 3-4 and described below is not intended to be limiting. Elements depicted in FIGS. 3-4 may be described above. For the sake of brevity, a further description of these elements is omitted.

FIG. 3 depicts a second operation 300 utilizing downhole tool 100. At operation 300, the cement within the downhole tool 100 removed and displaced by completion fluid. Furthermore, temporary member 156 may also be removed due to dissolving based on a time delay, heat, mechanical intervention or a combination. This may allow the screen 154 to be protected from the cement while allowing the inner sidewall of screen 154 to be unobstructed by temporary member 156 during a fracturing or production process.

Downhole tool 100 may be positioned within a geological formation with natural resources that are desired to be extracted, or across a geological formation where injection of fluid is desired.

In operation 300, frac ball 305 may be positioned on ball seat 152. When ball 305 is positioned on ball seat 152, a seal across the hollow chamber may be formed allowing pressure to increase within the hollow chamber. Due to the positioning of ball 305 on ball seat 152, the pressure within the hollow chamber may increase past a first threshold and break shear screws 132 and compress adjustable member 138. This may allow a distal end 310 of inner sleeve to sit on ledge 124, which may limit the compression of adjustable member 138.

Responsive to compressing adjustable member 138, inner sleeve 120 may move downward to align inner frac port 150 with outer frac port 134 to form a passageway from the hollow chamber, wherein the passageway extends through inner sleeve 120 and outer sidewall 110 and into the geological formation. Utilizing the passageway, a fracking mixture, fluid or material may be moved from the hollow chamber into the geological formation encompassing downhole tool 100.

Furthermore, when frac ports 150, 134 are aligned, screen, check valve, slotted grooves or flapper 154 may be misaligned with outer frac port 134.

FIG. 4 depicts a third operation 400 utilizing downhole tool 100. At operation 400, the pressure within the hollow chamber may decrease by no longer pumping fracking fluid through the hollow chamber. This may allow vertical adjustable member 138 to expand, and inner sleeve 120 may upwardly slide, which may position distal end 310 away from ledge 124.

Responsive to moving sleeve 120, screen 154 may be vertically aligned with outer frac port 134. Elements from the geological formation may be able to flow into the hollow chamber via outer frac port 134 and screen 154, wherein 154 may be configured to filter larger elements, such as sand, to enter the hollow chamber.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

What is claimed is:

1. A tool comprising:

an axially movable sleeve with an inner diameter, an outer diameter, and a screen, the screen being configured to filter materials flowing into a first port within the moveable sleeve, wherein the outer diameter of the movable sleeve is positioned adjacent to an inner diameter of the tool, wherein the screen is configured to move with the moveable sleeve; and a temporary member positioned on the inner diameter of the moveable sleeve, the temporary member being configured to temporarily cover an inner sidewall of the screen.

2. The tool of claim 1, further comprising:

a seal pair that is configured to straddle the screen when the screen is in a first position, the seal pair is configured to prevent a flow across the screen.

3. The tool of claim 2, wherein in a second position the seal pair does not straddle the screen allowing the flow across the screen.

4. The tool of claim 3 wherein the temporary member does not completely cover the inner sidewall of the screen to allow pressure communication within the tool and a cavity housing the screen; and a second port extending through the tool, wherein in the first position the first port is misaligned with the second port, and in the second position the first port is aligned with the second port.

5. The tool of claim 4, wherein the temporary member is configured to disappear or dissolve.

6. The tool of claim 5, wherein the temporary member is configured to dissolve after at least one of a predetermined amount of time and a heat threshold associated with the temporary member, or by mechanical methods.

7. The tool of claim 1, wherein a first portion of the temporary member is configured to be inserted into a recess on the inner diameter of the moveable sleeve above or below the screen or connected to the inner diameter of the moveable sleeve above or below the screen.

8. The tool of claim 7, wherein a second portion of the temporary member is configured to extend toward a distal end of the screen.

9. The tool of claim 1, wherein the temporary member is configured to allow communication between the inner diameter of the tool and a cavity housing the screen.

10. The tool of claim 1, wherein cement flows through the inner diameter of the tool while the temporary member is intact.

11. A method utilizing a tool comprising:

filtering, via a screen, materials flowing into a first port within an axially moveable sleeve, the moveable sleeve having an inner diameter, outer diameter, wherein the outer diameter of the movable sleeve is positioned adjacent to an inner diameter of the tool, wherein the screen is configured to move with the moveable sleeve;

positioning a temporary member on the inner diameter of the moveable sleeve, the temporary member temporarily covering an inner sidewall of the screen; and moving the moveable sleeve, wherein the screen moves along with the moveable sleeve.

12. The method of claim 11, further comprising:

preventing a flow across the screen, via a seal pair that straddles the screen, when the screen is in a first position.

13. The method of claim 12, further comprising:

allowing the flow across the screen by positioning the screen outside of the seal pair in a second position.

14. The method of claim 13, wherein the temporary member does not completely cover the inner sidewall of the screen to allow pressure communication within the tool and a cavity housing the screen; and a second port extends through the tool, wherein in the first position the first port is misaligned with the second port, and in the second position the first port is aligned with the second port.

15. The method of claim 14, further comprising:

dissolving or removing the temporary member.

16. The method of claim 15, wherein the temporary member is configured to dissolve after at least one of a predetermined amount of time and a heat threshold associated with the temporary member, or by mechanical methods.

17. The method of claim 11, further comprising:

inserting a first portion of the temporary member into a recess on the inner diameter of the moveable sleeve above or below the screen, or connecting to the inner diameter of the moveable sleeve above or below the screen.

18. The method of claim 17, wherein a second portion of the temporary member is configured to extend toward a distal end of the screen.

19. The method of claim 11, further comprising:

allowing communication, via the temporary member, between the inner diameter of the tool and a cavity housing the screen.

20. The method of claim 11, wherein cement flows through the inner diameter of the tool while the temporary member is intact.

* * * * *